US011858023B2

(12) United States Patent
Zhao et al.

(10) Patent No.: US 11,858,023 B2
(45) Date of Patent: Jan. 2, 2024

(54) ROTARY EXTRUSION FORMING METHOD FOR CABIN SECTION WORKPIECE

(71) Applicant: North University of China, Shanxi (CN)

(72) Inventors: Xi Zhao, Shanxi (CN); Zhimin Zhang, Shanxi (CN); Yong Xue, Shanxi (CN); Jianmin Yu, Shanxi (CN); Shuailing Kan, Shanxi (CN)

(73) Assignee: North University of China, Taiyuan (CN)

( * ) Notice: Subject to any disclaimer, the term of this patent is extended or adjusted under 35 U.S.C. 154(b) by 443 days.

(21) Appl. No.: 17/077,896

(22) Filed: Oct. 22, 2020

(65) Prior Publication Data

US 2021/0121928 A1 Apr. 29, 2021

(30) Foreign Application Priority Data

Oct. 25, 2019 (CN) ..... 201911024770.9

(51) Int. Cl.
*B21C 25/08* (2006.01)
*B21C 23/14* (2006.01)

(52) U.S. Cl.
CPC ..... *B21C 25/08* (2013.01); *B21C 23/14* (2013.01)

(58) Field of Classification Search
CPC ..... B21C 25/08; B21C 23/14
USPC ..... 72/253.1
See application file for complete search history.

(56) References Cited

FOREIGN PATENT DOCUMENTS

| | | | | |
|---|---|---|---|---|
| CN | 104399771 A | | 3/2015 | |
| CN | 104624694 | * | 5/2015 | |
| CN | 106607468 | * | 5/2017 | ..... B21C 23/18 |
| CN | 108580622 A | | 9/2018 | |
| CN | 109590348 A | | 4/2019 | |
| CN | 109692907 | * | 4/2019 | ..... B21D 37/00 |
| CN | 109692907 A | | 4/2019 | |
| CN | 208758353 U | | 4/2019 | |
| GB | 2414206 A | | 11/2005 | |

* cited by examiner

*Primary Examiner* — Jimmy T Nguyen
*Assistant Examiner* — Smith Oberto Bapthelus
(74) *Attorney, Agent, or Firm* — Dragon Sun Law Firm, PC; Nathaniel Perkins

(57) ABSTRACT

The present disclosure provides a rotary extrusion forming method for a cabin section workpiece, comprising the following steps of: first preparing a hollow truncated cone-shaped blank; heating the prepared blank to a molding temperature and holding, and preheating a female die and a male die to above the molding temperature and holding; assembling an upper die assembly on a press; applying lubricant on the female die and the male die, and placing and fixing the blank into a die cavity of the female die; starting up a rotation driving device to drive the female die to rotate on a lower die base, so that the female die drives the blank to rotate; starting up the press to make the male die move down to a machining position of the blank in the female die cavity through the upper die assembly, and machining inner side walls of the blank.

18 Claims, 12 Drawing Sheets

ROTARY EXTRUSION FORMING METHOD FOR CABIN SECTION WORKPIECE

CROSS-REFERENCE TO RELATED APPLICATION

The present disclosure claims the priority of the Chinese Patent Application No. 201911024770.9, filed to the SIPO on Oct. 25, 2019, titled "Rotary extrusion forming method for cabin section workpiece" which is incorporated herein by reference in its entirety.

TECHNICAL FIELD

The present disclosure belongs to the technical field of extrusion forming dies, and more particularly relates to a rotary extrusion forming method for a cabin section workpiece.

BACKGROUND OF THE PRESENT INVENTION

As a thin-walled load-bearing structure, irregularly-shaped thin-walled cabin section workpieces are widely used in aerospace, civil engineering, chemical industry, shipbuilding and other fields. In the existing plastic forming technology, it is impossible to form a main body of the irregularly-shaped thin-walled cabin section workpiece with different wall thickness through forward extrusion and reverse extrusion, and a generally adopted forming method includes the steps of first extruding a conical barrel-shaped workpiece with equal wall thickness, and then turning portions requiring thin wall thickness. However, this forming method has the disadvantages as follows.

First, the barrel body must have the maximum wall thickness required for forming, which is material wasting.

Second, the streamline is completely cut off, resulting in a reduction in the bearing capacity of the thin-walled portions.

Third, the production process takes too long.

No relevant solutions are available for the technical problems existing in the machining and forming process of the above irregularly-shaped thin-walled cabin section workpieces. Therefore, it is urgent to find an effective solution to solve the above problems.

SUMMARY OF THE PRESENT INVENTION

An objective of the present disclosure is to provide a rotary extrusion forming method for a cabin section workpiece to address the deficiencies in the above technology, so as to solve the problem of wasting materials in the machining and forming process of the existing irregularly-shaped thin-walled cabin section workpieces.

The present disclosure provides a rotary extrusion forming method for a cabin section workpiece, including a male die, a female die, an upper die assembly, a lower die base and a rotation driving device. The male die is arranged on the upper die assembly which can drive the male die to move in the vertical and horizontal directions. The female die is arranged on the lower die base in such a manner that it can rotate about a vertical axis, and the rotation driving device is in drive connection with the female die and can drive the female die to rotate about the vertical axis. The method further includes the following steps of:

S1: preparing a hollow truncated cone-shaped blank;

S2: heating the prepared blank to a molding temperature and holding, and preheating the female die and the male die to above the molding temperature and holding;

S3: assembling the upper die assembly on a press;

S4: applying lubricant on the female die and the male die, and placing and fixing the blank into a die cavity of the female die;

S5: starting up the rotation driving device to drive the female die to rotate on the lower die base, so that the female die drives the blank to rotate; starting up the press to move the male die down to a machining position of the blank in the die cavity through the upper die assembly, and machining inner side walls of the blank; and S6: after the blank is formed by machining, making the male die move up by the press to a preset position through the upper die assembly.

In some embodiments, after the male die moves out of the die cavity to the preset position, the method further includes a step of:

S7: jacking an ejector plate at the bottom of the die cavity up by an ejector bar, so as to strip the formed workpiece.

In some embodiments, in S2, the molding temperature to which the blank is heated is a recrystallization temperature of the blank material, and the blank is heated to the molding temperature and held at the temperature for 4 to 6 hours.

In some embodiments, the male die includes a left half male die and a right half male die, the upper die assembly includes a push-pull device, an upper die base and a press connector, and the left half male die and the right half male die are movably arranged on the upper die base along the horizontal direction. A wedge, arranged between the left half male die and the right half male die, is connected to the press connector. The upper die base and the press connector are respectively in drive connection with the press, and the push-pull device is arranged on the upper die base for driving the left half male die and the right half male die to move left and right along the horizontal direction. In S5 to S6, machining the inner side walls of the blank by the male die specifically includes steps as follows:

when the upper die base drives the left half male die and the right half male die to move down to the machining position of the blank in the die cavity, the press connector drives the wedge to move down, and the push-pull device drives the left half male die and the right half male die to feed separately to extrude the inner side walls of the blank; and after the left half male die and the right half male die extrude the inner side walls of the blank to a first forming position, the wedge remains motionless; after the upper die base drives the left half male die and the right half male die to move up to a second forming position, the press connector drives the wedge to move up; and after the push-pull device drives the left half male die and the right half male die to close and to move to a designated position, the upper die base drives the left half male die and the right half male die to move up to the preset position.

In some embodiments, an inclined surface is formed on both sides of the wedge, respectively, and inclined surfaces, on which the wedge is arranged in a sliding manner, are formed between the left half male die and the right half male die; the inclined surface on the left side of the wedge matches with the inclined surface of the left half male die and the inclined surface on the right side of the wedge matches with the inclined surface of the right half male die; the wedge slides up and down on the inclined surfaces between the left half male die and the right half male die to drive the left half male die and the right half male die to open or close.

In some embodiments, the inclined surfaces on the both sides of the wedge are consistent with the gradient of outer side walls of the blank, and/or are consistent with the gradient of the inclined surfaces of the left half male die and the right half male die.

In some embodiments, the die cavity, having an inner wall consistent with the gradient of the outer side walls of the blank, is provided in the female die.

In some embodiments, a circular cavity, having a floating device arranged at the bottom thereof, is provided on the lower die base, and the female die is rotatably arranged in the circular cavity and floats up and down in the circular cavity through the floating device; a stopper, having a groove arranged on an inner side face thereof, is provided on an upper end face of the lower die base; and an annular stiffener is provided on the outer side wall of the female die, and the female die is clamped in the groove through the annular stiffener and can float up and down in the groove.

In some embodiments, it further includes thrust bearing plates having an upper thrust bearing plate arranged at the bottom of the female die and a lower thrust bearing plate arranged at the bottom of the circular cavity. When the female die moves down to a lower limit position of the groove, the upper thrust bearing plate and the lower thrust bearing plate are interlocked to limit the movement of the female die.

In some embodiments, the blank is magnesium alloy, aluminum alloy or titanium alloy.

The rotary extrusion forming method for a cabin section workpiece provided by the present disclosure can avoid machining by cutting, improve material utilization rate, and reduce consumption in subsequent machining stages, thereby reducing the production cost and improving the production efficiency. On the other hand, it can also improve the mechanical performance of the main body and avoid the decline in the load-bearing capacity caused by cutting-off streamline. Furthermore, by employing the solution provided by the present disclosure, the workpiece adopts an isothermal forming mode in its forming process, i.e., the blank is always closed in the female die in the forming process, thereby avoiding the temperature reduction of the blank, eliminating the uneven deformation caused by the heat exchange between the blank and the air, further improving the deformation uniformity and reducing the wall thickness difference.

BRIEF DESCRIPTION OF THE DRAWINGS

The present disclosure will be further described in detail as below with reference to the accompanying drawings by the specific embodiments.

The present disclosure will be further described with reference to the accompanying drawings.

in which:

10: press connector; 11: upper die base; 12: wedge; 121: inclined surface; 122: inclined surface; 13: left half male die; 131: inclined surface; 14: right half male die; 141: inclined surface; 15: left half male die retainer; 16: right half male die retainer; 17: left retainer hydraulic cylinder; 18: right retainer hydraulic cylinder; 19: female die; 191: outer side wall; 192: annular stiffener; 193: die cavity; 195: short stiffener; 20: rotation driving device; 201: first gear; 202: first pulley; 203: second gear; 204: second pulley; 205: clutch; 206: motor; 21: stopper; 210: annular oil gallery; 22: lower die base; 221: circular cavity; 222: annular oil gallery; 23: thrust bearing plate; 24: steel ball bearing bracket; 241: receiving cavity; 25: steel ball; 251: annular groove; 26: spring; 27: ejector bar; 28: through hole; 29: ejector plate; 291: first notch; 292: second notch; 3: blank; 31: inner side wall; 32: outer side wall; and 33: bulge.

DETAILED DESCRIPTION OF THE PRESENT INVENTION

It should be noted that the embodiments and characteristics therein of the present disclosure may be combined with each other without conflict. The present disclosure will be described in detail as below with reference to the accompanying drawings by the embodiments.

Figure 1:
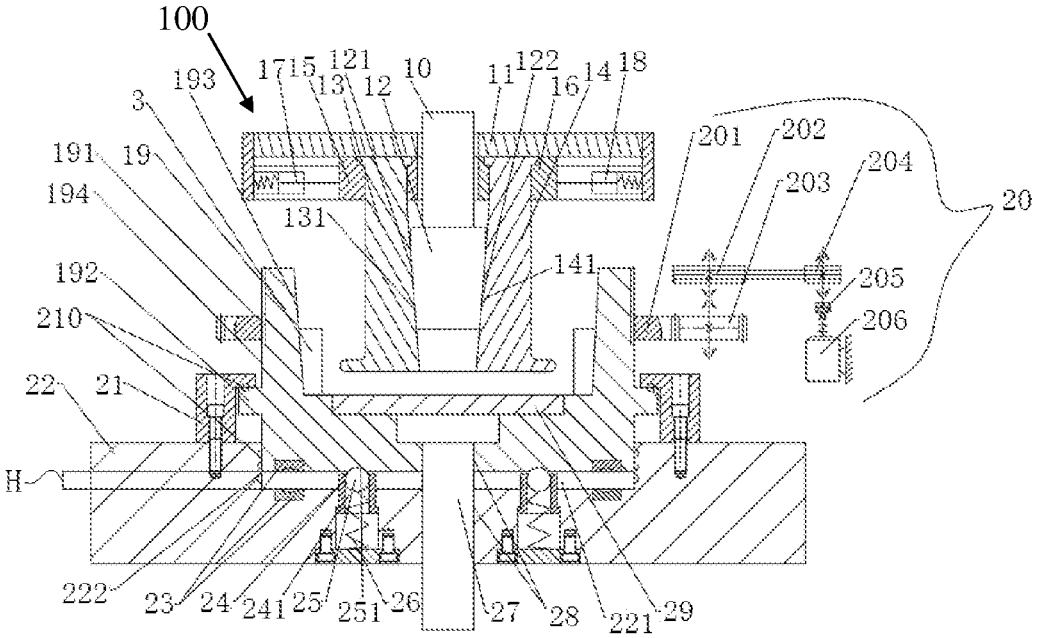
FIG. 1 is an assembly diagram of a rotary extrusion forming die for a cabin section workpiece according to the present disclosure.
Figure 2:
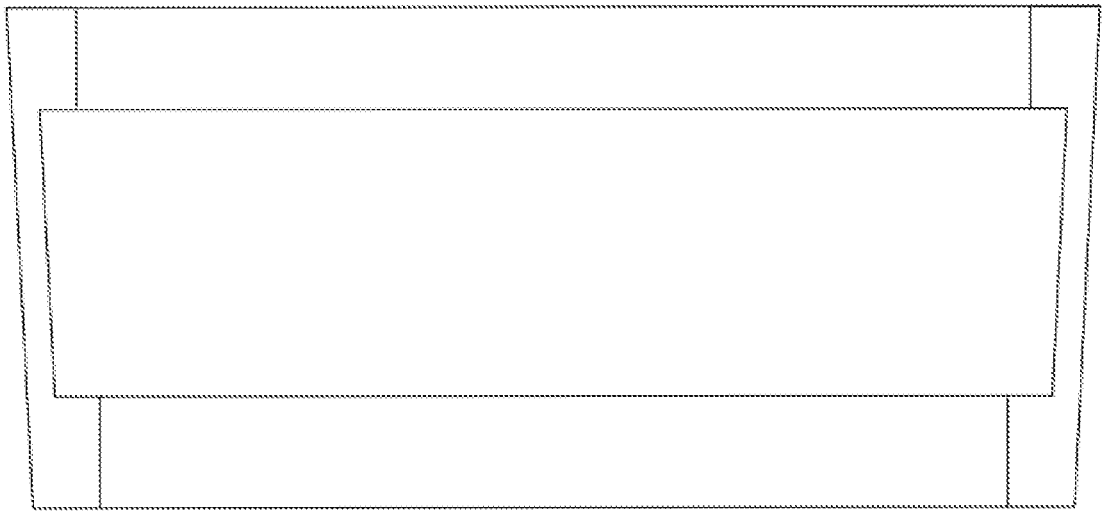
FIG. 2 is a schematic diagram of an irregularly-shaped thin-walled cabin section workpiece according to the present disclosure.
Figure 3:
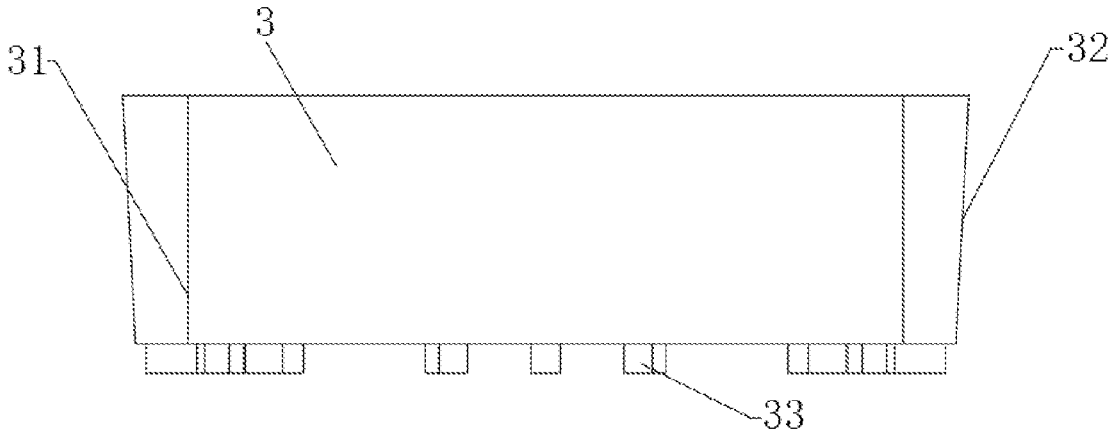
FIG. 3 is a front view of a blank according to the present disclosure.
Figure 4:
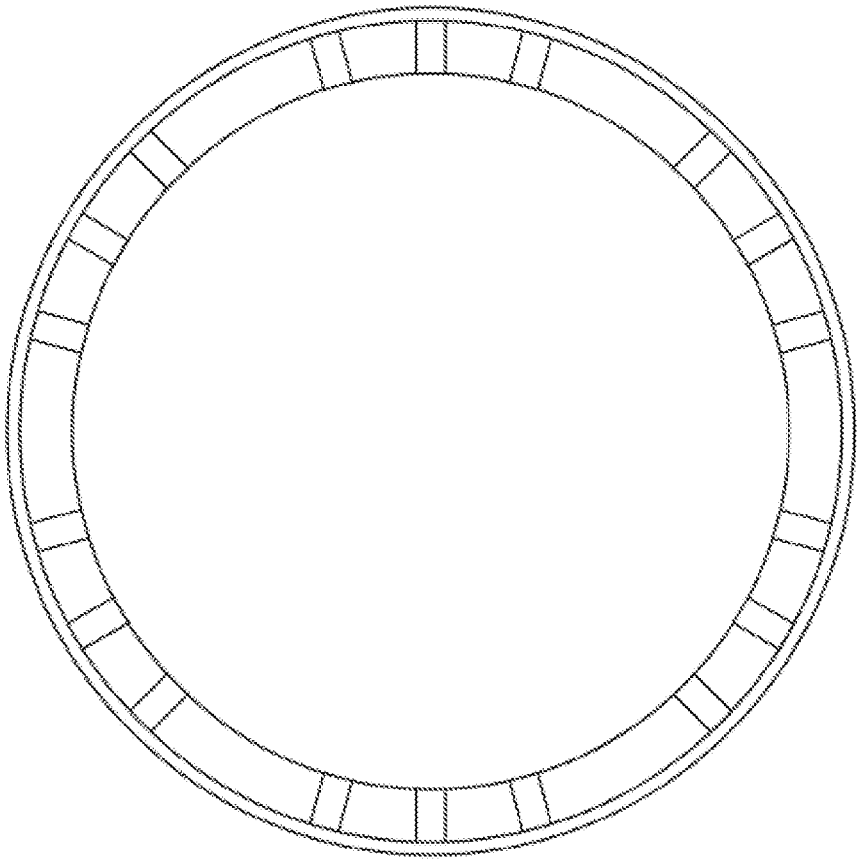
FIG. 4 is a top view of the blank according to the present disclosure.
Figure 5:
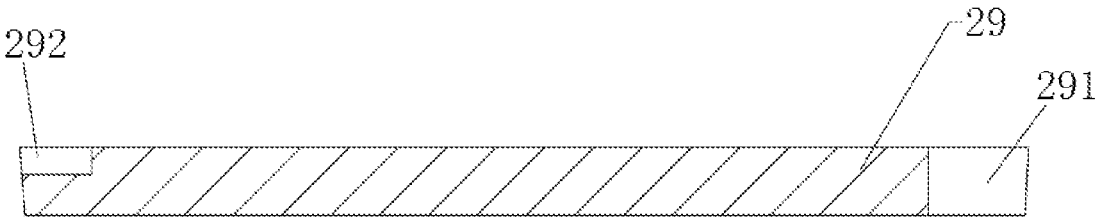
FIG. 5 is a front view of an ejector plate according to the present disclosure.
Figure 6:
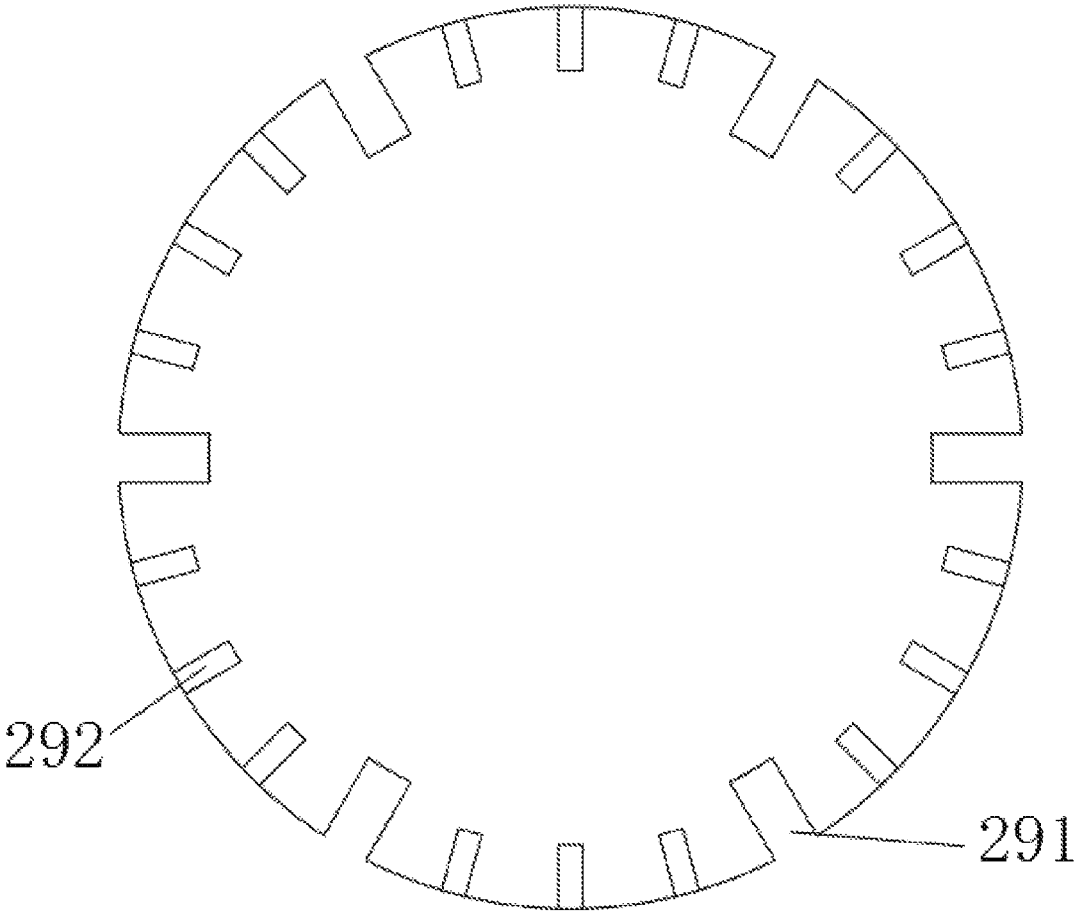
FIG. 6 is a top view of the ejector plate according to the present disclosure.
Figure 7:
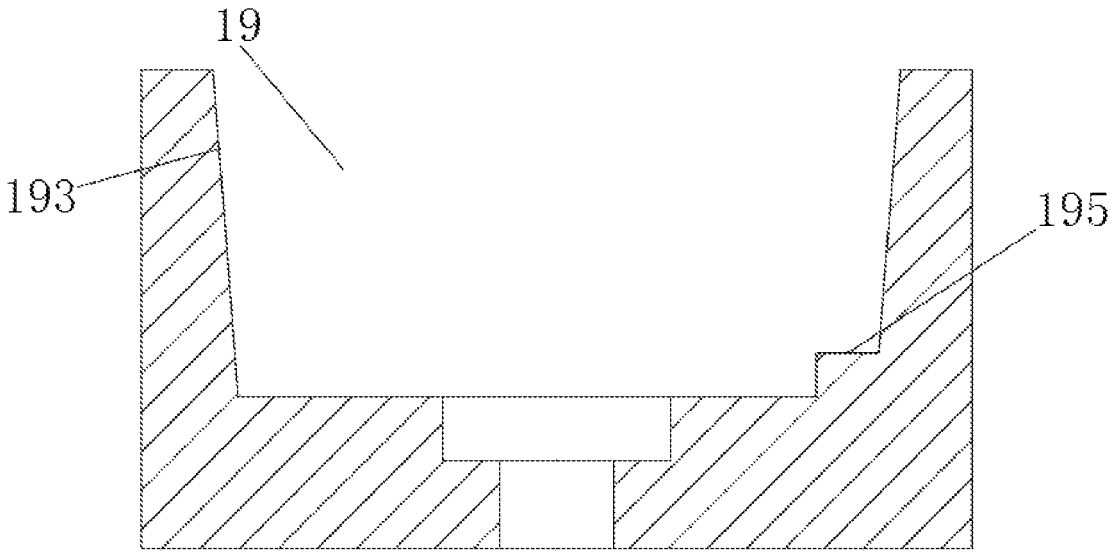
FIG. 7 is a front view of a female die according to the present disclosure.
Figure 8:
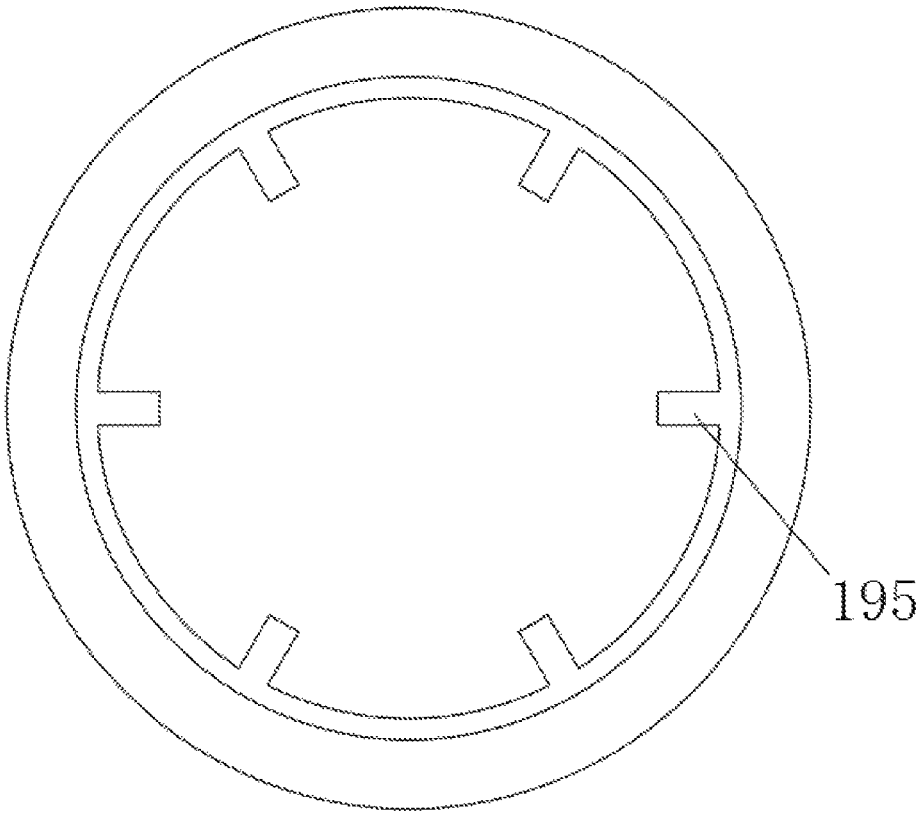
FIG. 8 is a top view of the female die according to the present disclosure.
Figure 9:
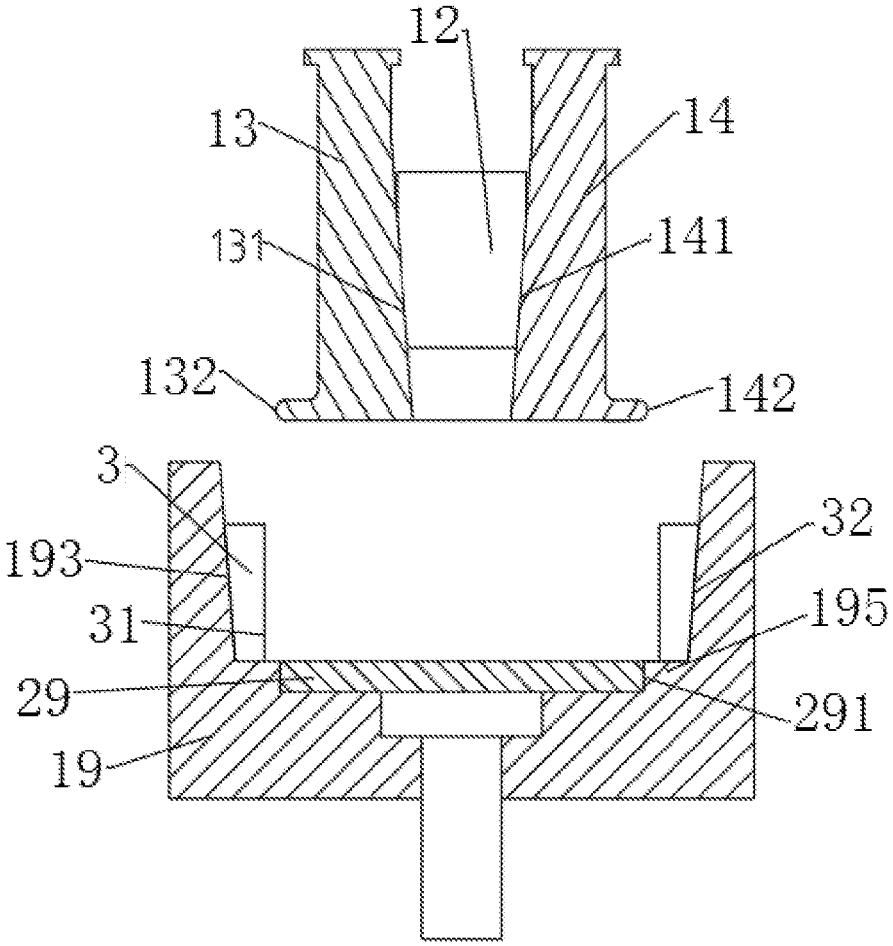
FIG. 9 is a schematic diagram in which a left half male die and a right half male die have not moved down according to the present disclosure.
Figure 10:
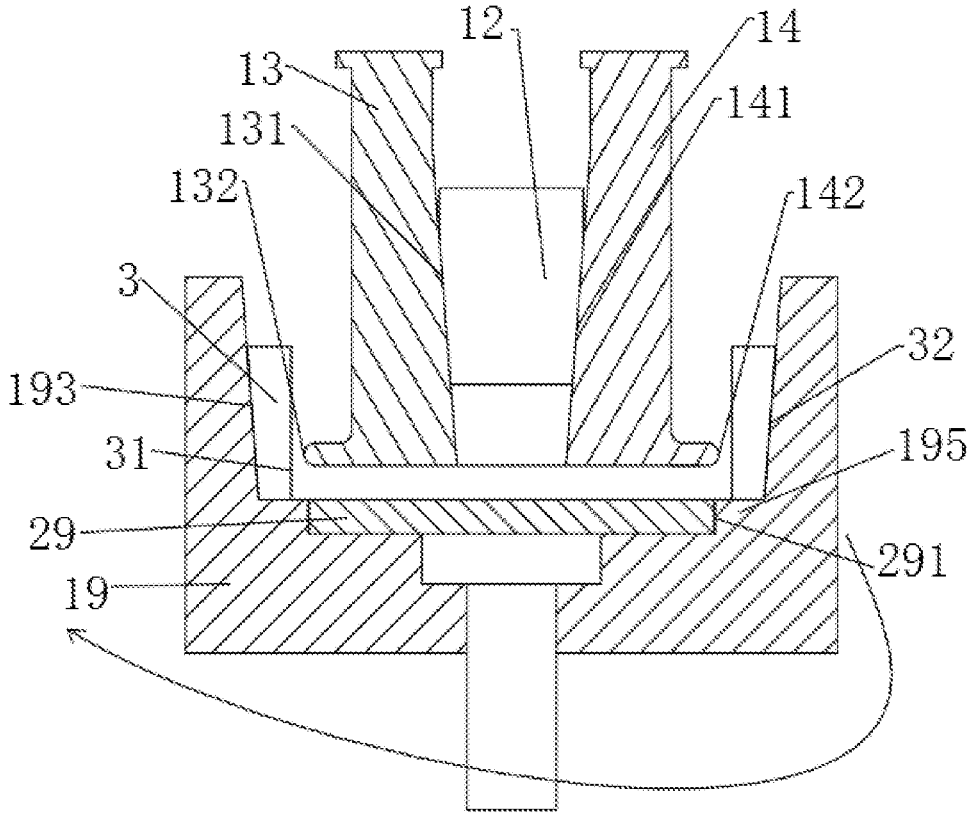
FIG. 10 is a schematic diagram in which the left half male die and the right half male die have moved down according to the present disclosure.
Figure 11:
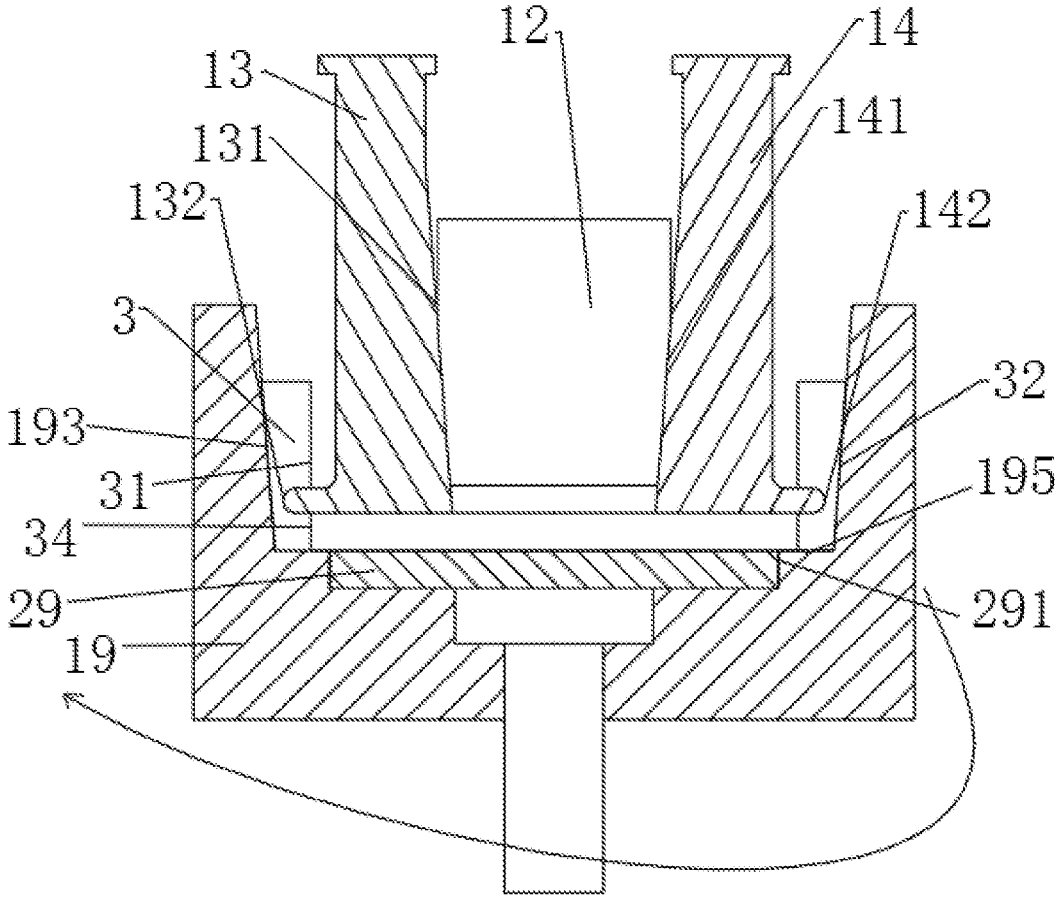
FIG. 11 is a schematic diagram in which the left half punch and the right half punch step left and right and the die rotates with the blank according to the present disclosure.
Figure 12:
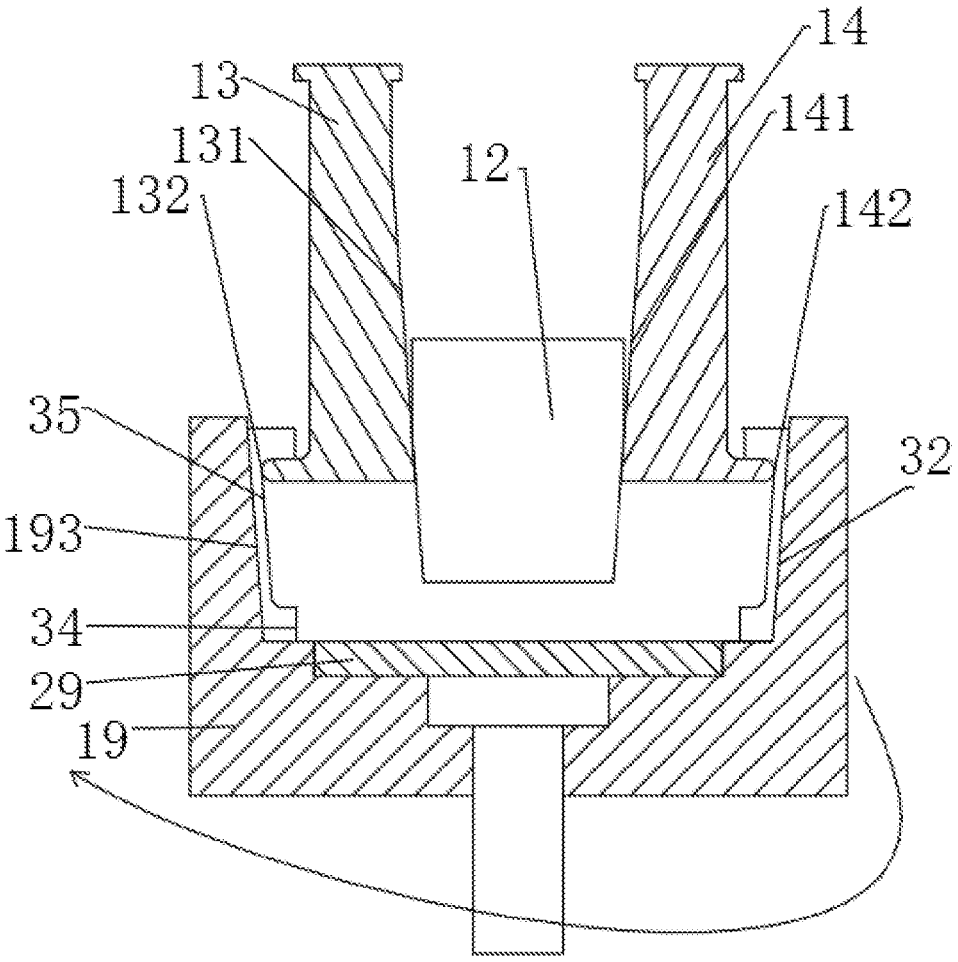
FIG. 12 is a schematic diagram in which the left half male die and the right half male die have moved up and the female die rotates with the blank according to the present disclosure.
Figure 13:
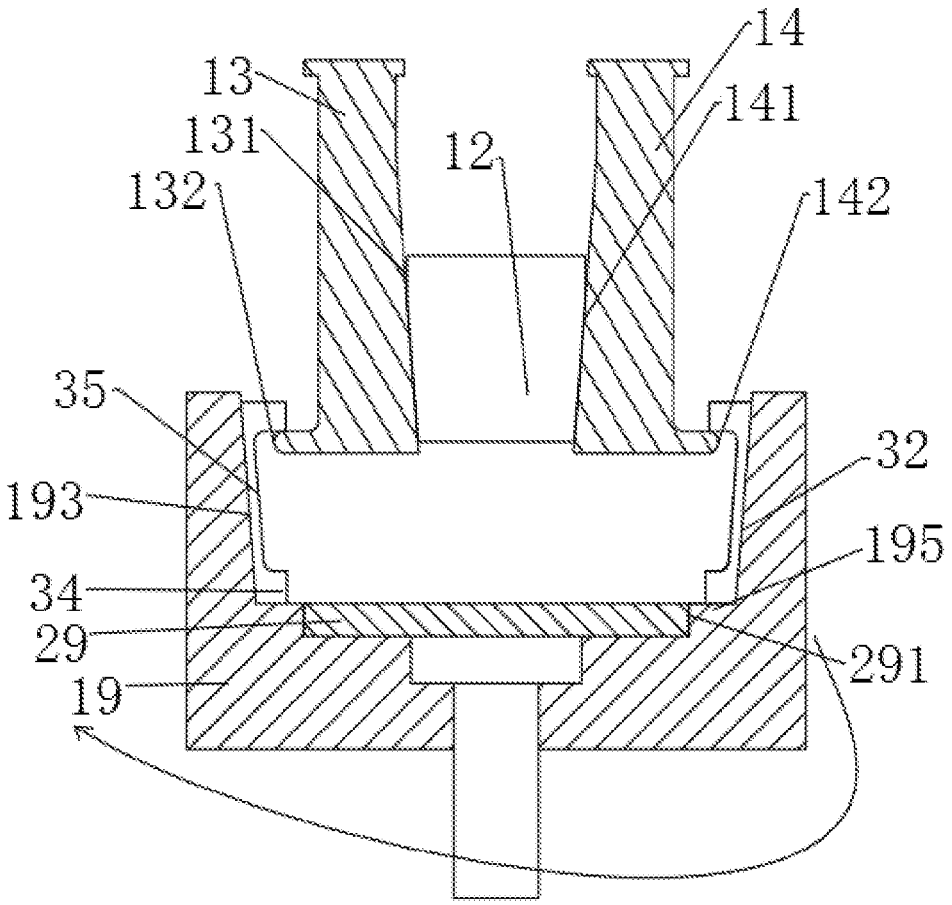
FIG. 13 is a schematic diagram in which the left half male die and the right half male die move towards each other in opposite directions according to the present disclosure.
Figure 14:
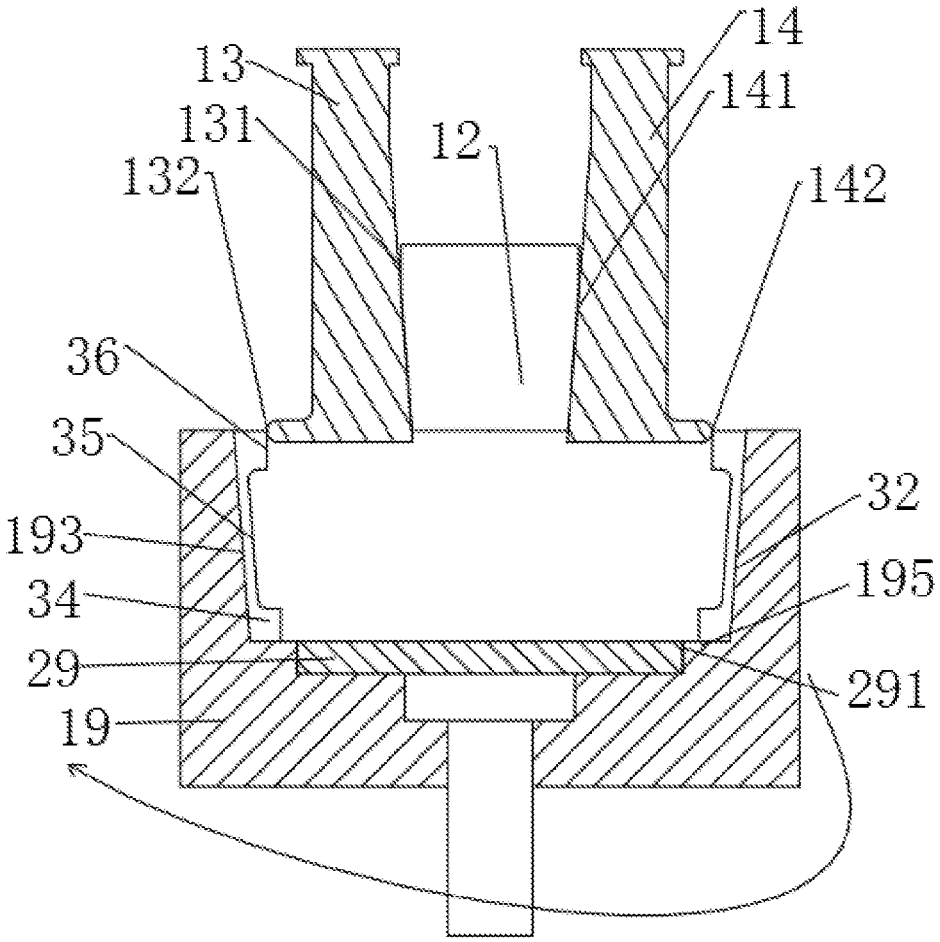
FIG. 14 is a schematic diagram in which the left half male die and the right half male die have moved up and the female die rotates with the blank according to the present disclosure.
Figure 15:
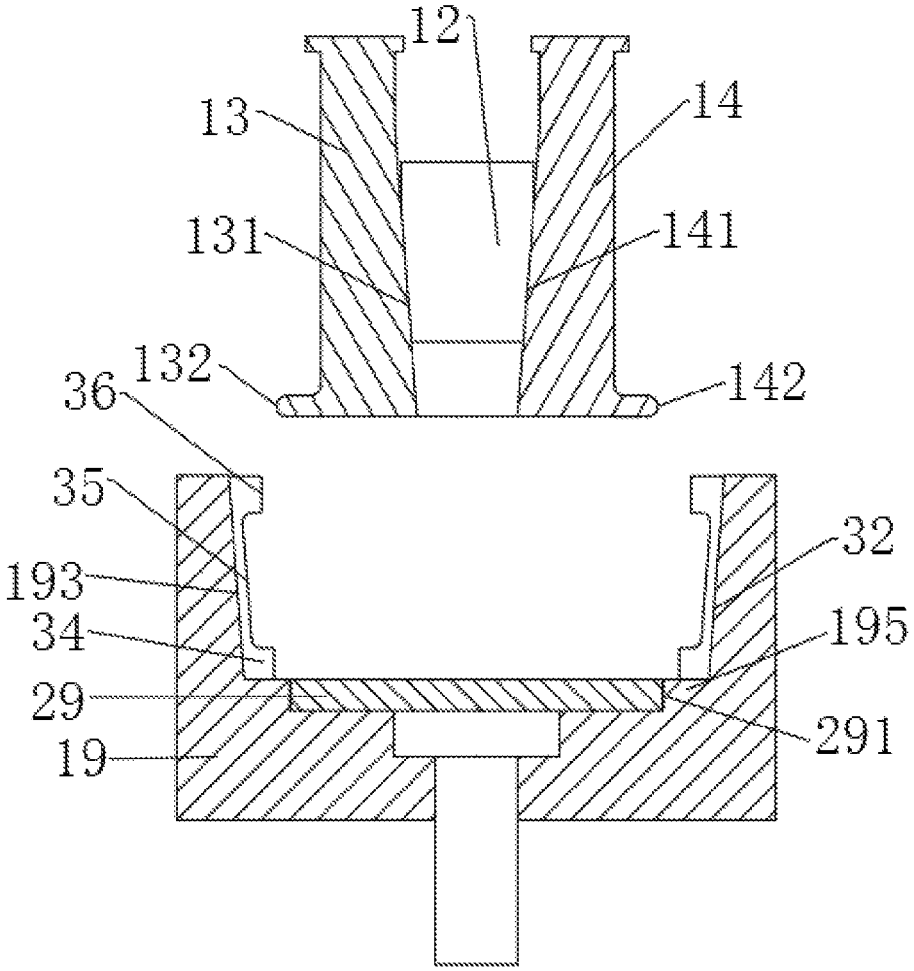
FIG. 15 is a schematic diagram in which the female die stops rotating and the left half male die and the right half male die are closed and move up according to the present disclosure.
Figure 16:
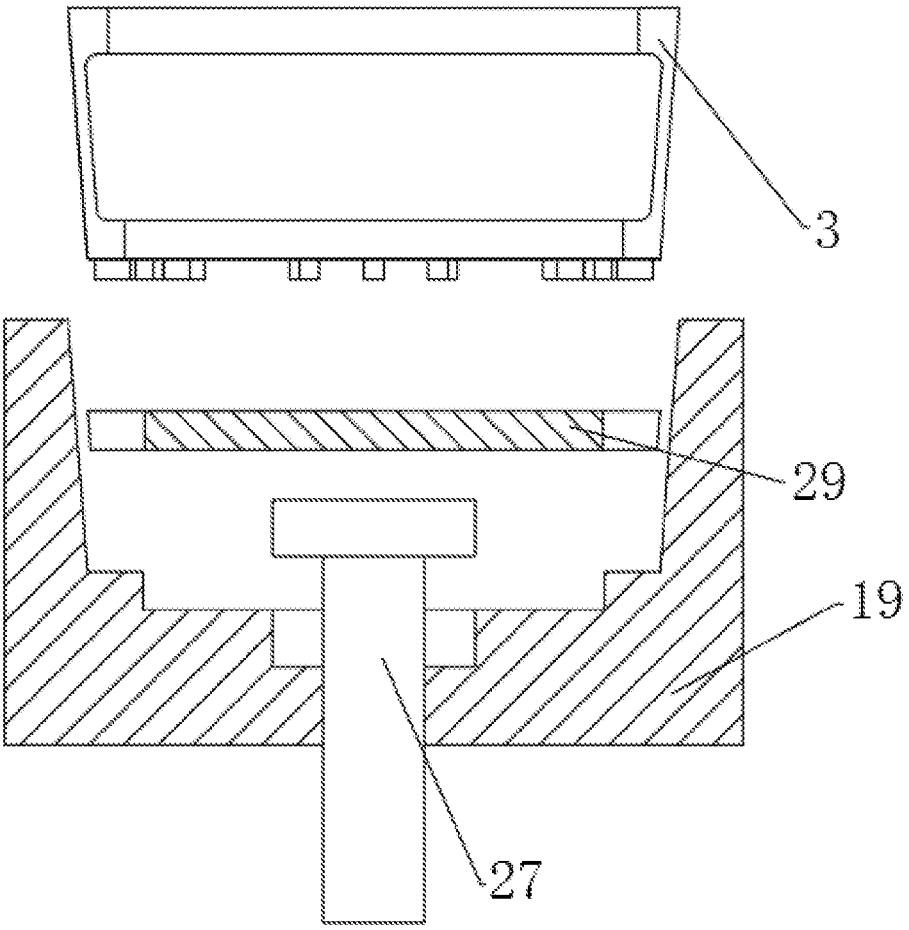
FIG. 16 is a schematic diagram of the ejection of a formed workpiece according to the present disclosure.

As shown in FIGS. 1 to 16, the present disclosure provides a rotary extrusion forming die for a cabin section workpiece, which is mainly used for extrusion forming of an irregularly-shaped thin-walled cabin section workpiece. The forming die includes a male die, a female die 19, an upper die assembly 100 and a lower die base 22. The female die 19 is a floating die which can rotate on the lower die base 22 and float up and down. Specifically, a die cavity 193 is provided in the female die 19, and can be used for receiving a blank 3, and the female die 19 arranged on the lower die base 22 in such a manner that it can rotate about a vertical axis, i.e., the groove 19 can rotate horizontally on the lower die base 22. The male die is arranged on the upper die assembly 100 and can extend into the die cavity 193 along with the upper die assembly 100, and the upper die assembly 100 can drive the male die to move in the vertical and horizontal directions to perform extrusion forming on the blank 3 in the die cavity 193, thus extruding the blank 3 into the cabin section workpiece of an irregularly-shaped thin-walled structure. The irregularly-shaped thin-walled structure refers to a thin-walled structure of the cabin section workpiece with a non-straight wall face as its machining face. With the above solution, the deficiencies of the traditional turning technology are overcome, and the workpiece can be formed by one-time heating and one-time rotary extrusion of a main body thereof under the condition of mass production, which avoids machining by cutting, improves material utilization rate, and reduces consumption in subsequent machining stages, thereby reducing the production cost, improving the production efficiency and effectively shortening the production process.

Preferably, in the embodiment combined with the above solution, as shown in FIGS. 1 to 16, the male die includes a left half male die 13 and a right half male die 14, and the upper die assembly 100 includes an upper die base 11 and a push-pull device, wherein the left half male die 13 and the right half male die 14 are movably arranged on the upper die base 11 along the horizontal direction, and a push-pull device is arranged on the upper die base 11 and connected to the left half male die 13 and the right half male die 14 respectively, so as to drive the left half male die 13 and the right half male die 14 to move left and right in the horizontal direction. The upper die base 11 is connected to a press to drive the left half male die 13 and the right half male die 14 to move up and down in the vertical direction, thereby performing extrusion forming on the blank 3.

Preferably, in the embodiment combined with the above solution, as shown in FIGS. 1 to 16, the upper die assembly 100 further includes a press connector 10 and a wedge 12. An inclined surface 121 is formed on both sides of the wedge 12 respectively, and inclined surfaces are formed between the left half male die 13 and the right half male die 14, wherein an inclined surface 131 is provided on one side of the left half male die 13 while an inclined surface 141 is provided on one side of the right half male die 14, and the inclined surfaces 121 on the both sides of the wedge 12 are fitted to the inclined surface 131 of the left half male die 13 and the inclined surface 141 of the right half male die 14. Further, the wedge 12 is arranged in a sliding manner on the inclined surfaces between the left half male die 13 and the right half male die 14. The inclined surface on the left side of the wedge 12 matches with the inclined surface 131 of the left half male die 13 and that on the right side of the wedge 12 matches with the inclined surface 141 of the right half male die 14. The top of the wedge 12 is also connected to the press connector which is connected to the press through the upper die base 11, so as to drive the wedge 12 to move up and down. The press is a double-action press, which can drive the upper die base 11 and wedge 12 to move respectively. With the above solution, on one hand, the press connector 10 acts on the upper die base 11 to drive the upper die base 11 to move up and down, thereby driving the left half male die 13 and the right half male die 14 to move up and down. On the other hand, the press connector 10 acts on the wedge 12 to drive the wedge 12 to move up and down, so that when the push-pull device drives the left half male die 13 and the right half male die 14 to open and close to a preset width, and the wedge 12 is used to limit the horizontal movement of the left half male die 13 and the right half male die 14. In this way, the horizontal radial pressure between the left half male die 13 and the right half male die 14 can be counteracted during the extrusion of the blank 3, thus improving the machining stability of the workpiece.

Preferably, in the embodiment combined with the above solution, as shown in FIGS. 1 to 16, the push-pull device includes a left half male die retainer 15, a left retainer hydraulic cylinder 17, a right half male die retainer 16 and a right retainer hydraulic cylinder 18. The left half male die 13 is arranged on the upper die base 11 through a left half male die retainer 15, and the left retainer hydraulic cylinder 17 is arranged on the upper die base 11 to drive the left half male die 13 to move left and right. Similarly, the right half male die 14 is arranged on the upper die base 11 through the right half male die retainer 16, and the right retainer hydraulic cylinder 18 is arranged on the upper die base 11 to drive the right half male die 14 to move left and right. Specifically, one end of the left retainer hydraulic cylinder 17 is fixed on the upper die base 11 while the other end thereof is fixed on the left half male die retainer 15. One end of the right retainer hydraulic cylinder 18 is fixed on the upper die base 11 while the other end thereof is fixed on the right half male die retainer 16. The left half male die retainer 15 and the right half male die retainer 16 slide left and right on the upper die base 11 respectively through the left retainer hydraulic cylinder 17 and the right retainer hydraulic cylinder 18. In some embodiments, the left half male die retainer 15 and the right half male die retainer 16 are mounted on the upper die base 11 through guide grooves with a T-shaped section, and can slide left and right on the T-shaped guide grooves, to achieve tight fit. In some embodiments, the left retainer hydraulic cylinder 17 and the right retainer hydraulic cylinder 18 respectively drive the left half male die 13 and the right half male die 14 to move at the same time, and an elastic buffer, which plays a buffering role, is provided at a coupling end of the right retainer hydraulic cylinder 18 and the upper die base 11.

Preferably, in combination with the above solution, as shown in FIGS. 1 to 16, the rotary extrusion forming die for a cabin section workpiece provided by the present disclosure further includes a rotation driving device 20, which is arranged on the side of the female die 19 to drive the female die 19 to rotate about the vertical axis. Specifically, the rotation driving device 20 includes a first gear 201, a first pulley 202, a second gear 203, a second pulley 204 and a motor 206. A keyway, which is inlaid with a flat key and connected to the first gear 201 through the flat key, is provided on the outer side wall 191 of the female die 19, and the first gear 201 is engaged with the second gear 203 which is in drive connection with the first pulley 202. The first pulley 202 is in drive connection with the second pulley 204 through a belt, and the motor 206 is in drive connection with the second pulley 204 through a clutch 205 to drive the second pulley 204 to rotate. Specifically, the clutch 205 is a dog clutch, and the power of the motor 206 is transmitted to the female die 19 through a coupling, the clutch 205, the second pulley 204, the first pulley 202, the second gear 203 and the first gear 201. By controlling the clutch 205, the power transmission between the motor 206 and the female die 19 can be randomly connected and disconnected. According to the actual power required for extruding and rotating functions, the blank of various sizes can be extruded and rotated by replacing the motor 206 and a variable gearing mechanism.

Preferably, in combination with the above solution, as shown in FIGS. 1 to 16, the rotary extrusion forming die for a cabin section workpiece provided by the present disclosure further includes a floating device. A circular cavity 221 is provided on the lower die base 22, and the floating device is arranged at the bottom of the circular cavity 221 for driving the female die 19 to float up and down. Specifically, the female die 19 is rotatably arranged in the circular cavity 221 and located at an upper end of the floating device, and the floating device is used for driving the female die 19 to float up and down. In some embodiments, there are a plurality of floating devices, which are uniformly distributed at the bottom of the circular cavity 221, and are respectively used for driving the female die 19 to float up and down and keep balance.

Preferably, in the embodiment combined with the above solution, as shown in FIGS. 1 to 16, the floating device includes steel ball bearing brackets 24, steel balls 25 and springs 26. Specifically, steel ball bearing bracket 24 is fixedly arranged in the lower die base 22 by screws, and a receiving cavity 241 with the spring 26 inside is arranged in the steel ball bearing bracket 24. The steel ball 25 is arranged in the receiving cavity 241 and located at the top of the spring 26, and can move up and down as the spring 26 stretches. Annular grooves 251 are correspondingly provided at the bottom of the female die 19, and the steel ball 25 can roll in the annular groove 251 under the acting force of the spring. With the above solution, the floating device can drive the female die 19 to float up and down on the lower die base 22. In addition, as the annular grooves 251 are correspondingly provided at the bottom of the female die 19, the floating device and the female die 19 are connected more reliably without easily disengaging from each other.

Preferably, in combination with the above solution, as shown in FIGS. 1 to 16, in order to make the structure of the forming die more stable, the rotary extrusion forming die for a cabin section workpiece provided by the present disclosure further includes stopper 21. Stopper 21 is fixedly arranged on an upper end face of the lower die base 22 and located at the side of the circular cavity 221. A groove is provided on an inner side of the stopper 21 along the radial direction of the female die 19, and an annular stiffener 192 is provided on the outer side wall 191 of the female die 19. The female die 19 extends into the groove through the annular stiffener 192 and can float up and down in the groove, and the stopper 21 plays a role of limiting position in the radial direction of the female die 19. With the above solution, the female die 19 can stably float up and down in the stopper 21, with its floating height H being limited by the stopper 21, so the female die 19 is not easy to fall off, and the stopper 21 can act as a guide to improve forming accuracy.

Preferably, in the embodiment combined with the above solution, as shown in FIGS. 1 to 16, annular oil galleries 210 are provided in positions where the annular stiffeners 192 is in contact with the groove. With this solution, the annular oil galleries 210 are provided at the contact surfaces between the groove and the annular stiffeners 192, which can reduce the friction between the groove and the annular stiffeners 192. Similarly, the annular oil galleries 210 are provided in positions where the side wall of the female die 19 is in contact with the circular cavity 221, which can also reduce the friction between the side wall of the female die 19 and the circular cavity 221.

Preferably, in combination with the above solution, as shown in FIGS. 1 to 16, the rotary extrusion forming die for a cabin section workpiece provided by the present disclosure further includes thrust bearing plates 23 having an upper thrust bearing plate arranged at the bottom of the female die 19 and a lower thrust bearing plate arranged at the bottom of the circular cavity 221. When the female die 19 moves down to a lower limit position of the groove, the upper thrust bearing plate and the lower thrust bearing plate are interlocked through a locking structure, thereby limiting the movement of the female die 19. Specifically, the locking structure can be a bump and groove structure.

Preferably, in combination with the above solution, as shown in FIGS. 1 to 16, the rotary extrusion forming die for a cabin section workpiece provided by the present disclosure further includes a stripping device which includes an ejector bar 27 and an ejector plate 29, wherein a through hole 28 is arranged at the center of the die cavity 193, the ejector plate 29 is arranged at the bottom of the die cavity 193, the blank 3 is located at an upper end of the ejector plate 29, and the ejector bar 27 is telescopically arranged in the through hole 28. Specifically, one end of the ejector bar 27 passes through the through hole 28 and abuts against the ejector plate 29, and the other end thereof is connected to a drive member. In some embodiments, a plurality of notches for interlocking with short stiffeners 195 on the female die are provided circumferentially on the ejector plate 29, and there may be five, six or seven notches. In some embodiments, there may be five, six or seven short stiffeners 195 on the female die corresponding to the notches. With the above solution, the ejector bar 27 can jack up the ejector plate 29, so that the formed workpiece is separated from the die cavity 193 to facilitate unloading and stripping.

Preferably, in the embodiment combined with the above solution, as shown in FIGS. 1 to 16, in order to facilitate the rotation of the blank 3 along with the female die 19, the blank 3 is of a hollow structure into which the male die can extend, to extrude the inner side wall 31 of the blank 3. The outer side wall 32 of the blank 3 is fitted in the die cavity 193, and bulges 33 are provided at the bottom of the blank 3. First notches 291 and second notches 292 are provided on the ejector plate 29, the short stiffeners 195 matched with the first notches 291 are provided at the bottom of the die cavity 193, and the blank 3 is clamped in the second notches 292 through the bulges 33 to avoid self-rotation during rotation.

The rotary extrusion forming die for a cabin section workpiece provided by the present disclosure can avoid machining by cutting, improve material utilization rate, and reduce consumption in subsequent machining stages, thereby reducing the production cost and improving the production efficiency. On the other hand, it can also improve the mechanical performance of the main body of the workpiece and avoid the decline in the load-bearing capacity caused by cutting-off streamline. Furthermore, by employing the solution provided by the present disclosure, the workpiece adopts an isothermal forming mode in the forming process, i.e., the blank is always closed in the female die in the forming process, thereby avoiding the temperature reduction of the blank, eliminating the uneven deformation caused by the heat exchange between the blank and the air, further improving the deformation uniformity and reducing the wall thickness difference.

Accordingly, in combination with the above solution, as shown in FIGS. 1 to 16, the present disclosure also provides a rotary extrusion forming method for a cabin section workpiece, which can be applied to the rotary extrusion forming die for a cabin section workpiece. Further, the method specifically includes a male die, a female die, an upper die assembly 100, a lower die base and a rotation driving device. The male die is arranged on the upper die assembly 100 which can drive the male die to move up and down in the vertical direction and to move left and right in the horizontal direction; the female die is arranged on the lower die base in such a manner that it can rotate about a vertical axis; and the rotation driving device is in drive connection with the female die and can drive the female die to rotate about the vertical axis. The method further includes the following steps as follows.

S1: Blanking is performed to prepare a hollow truncated cone-shaped blank. Specifically, the blank is preferably made of light alloy, which is aluminum alloy, titanium alloy or magnesium alloy, and so on.

S2: Preparation for forming is performed, namely the prepared blank is heated to a molding temperature and held at this temperature, the molding temperature to which the blank is heated is a recrystallization temperature of the blank material, after the blank is heated to the molding temperature (i.e., the recrystallization temperature), the holding time is preferably 4-6 hours, preferably 4 hours, and the female die and the male die are preheated to above the molding temperature and held.

S3: Die assembly is performed, namely the upper die assembly 100 is assembled on a press. Further, the die assembly includes an upper die base and a press connector which are in drive connection with the press respectively, and the press is a double-action press. The male die includes a left half male die and a right half male die which are movably arranged on the upper die base along the horizontal direction. A wedge connected to the press connector is arranged between the left half male die and the right half male die, and the upper die base and the press connector are in drive connection with the press respectively.

S4: Lubricant is applied evenly on the die cavity 193 of the female die 19, the left half male die 13 and the right half male die 14, and the heated blank is put and fixed into the die cavity 193 of the female die 19. The lubricant application is mainly used to facilitate die stripping. At the same time, the deformation between the blank and the die cavity 193 in the process of extruding the blank by the male die can be avoided, and the machining accuracy is improved.

S5: Forming is performed, namely the rotation driving device is started up to drive the female die to rotate on the lower die base, so that the female die drives the blank to rotate; the press is started up to move the male die down to a machining position of the blank in the die cavity through the upper die assembly 100, and the inner side walls of the blank are machined.

S6: After the blank is formed by machining, the press makes the male die up move to a preset position through the press connector.

S7: An ejector plate at the bottom of the die cavity is jacked up by an ejector bar, so as to strip the formed workpiece.

S8: Application of lubricating oil is continued, so as to proceed with the next process of rotary extrusion of a shaped thin-walled cabin section workpiece.

With the above solution, the deficiencies of the traditional turning technology are overcome, and the workpiece can be formed by one-time heating and one-time rotary extrusion of a main body thereof under the condition of mass production, which avoids machining by cutting, improves material utilization rate, and reduces consumption in subsequent machining stages, thereby reducing the production cost, improving the production efficiency and effectively shortening the production process.

Preferably, in the embodiment combined with the above solution, the workpiece machining process is as follows: the rotation driving device 20 is started up to drive the female die 19 to rotate on the lower die base 22, and the female die 19 drives the blank 3 to rotate, and the left half male die 13 and the right half male die 14 are closed on the upper die base 11 and fixed under the press connector 10. The upper die base 11 drives the left half male die 13 and the right half male die 14 to move down. When the left half male die 13 and the right half male die 14 move down to the machining position in the blank 3, the press connector 10 drives the wedge 12 to move down, and a push-pull device drives the left half male die 13 and the right half male die 14 to feed separately, so as to start to extrude the inner side wall 31 of the blank 3. After a first forming position is reached, the wedge 12 remains motionless, and the upper die base 11 drives the left half male die 13 and the right half male die 14 to move up. After a second forming position is reached, the press connector 10 drives the wedge 12 to move up, and a gap is left between the left half male die 13 and the right half male die 14, so that the push-pull device pushes the left half male die 13 and the right half male die 14 to move left and right. After a designated position is reached, the upper die base 11 drives the left half male die 13 and the right half male die 14 to move up, and the formed workpiece and an ejector plate 29 held in the female die 19 are jacked up by an ejector bar 27 to complete die stripping.

Preferably, in the embodiment combined with the above solution, an inclined surface is formed on both sides of the wedge, respectively, and inclined surfaces, on which the wedge is arranged in a sliding manner, are formed between the left half male die and the right half male die; the inclined surface on the left side of the wedge matches with the inclined surface of the left half male die and the inclined surface on the right side of the wedge matches with the inclined surface of the right half male die. The wedge slides up and down on the inclined surfaces between the left half male die and the right half male die to drive the left half male die and the right half male die to open or close.

Preferably, in the embodiment combined with the above solution, as shown in FIGS. 1 to 16, the inclined surfaces 121 on the both sides of the wedge 12 are consistent with the gradient of an outer side wall 32 of the blank, and/or are consistent with the gradient of the inclined surfaces of the left half male die 13 and the right half male die 14. In some embodiments, the die cavity 193 is provided in the female die 19, and the inner wall of the die cavity 193 is consistent with the gradient of the outer side walls 32 of the blank.

Preferably, in the embodiment combined with the above solution, as shown in FIGS. 1 to 16, a circular cavity 221, having a floating device arranged at the bottom thereof, is provided on the lower die base 22, and the female die 19 is rotatably arranged in the circular cavity 221 and floats up and down in the circular cavity 221 through the floating device. A stopper 21, having a groove arranged on an inner side face thereof, is provided on an upper end face of the lower die base 22. An annular stiffener 192 is provided on the outer side wall 191 of the female die 19, and the female die 19 is clamped in the groove through the annular stiffener 192 and can float up and down in the groove.

Preferably, in the embodiment combined with the above solution, as shown in FIGS. 1 to 16, it further includes thrust bearing plates 23 having an upper thrust bearing plate arranged at the bottom of the female die 19 and a lower thrust bearing plate arranged at the bottom of the circular cavity 221. When the female die 19 moves down to a lower limit position of the groove, the upper thrust bearing plate and the lower thrust bearing plate are interlocked through a locking structure, thereby limiting the movement of the female die 19. Specifically, the locking structure can be a bump and groove structure.

With the above solution, the blanking can be performed by sawing the ready-made blank, the workpiece can be formed by one-time heating and one-time rotary extrusion of a main body thereof, which avoids machining by cutting, improves material utilization rate, and reduces consumption in subsequent machining stages, thereby reducing the production cost and improving the production efficiency Those described above are merely preferred embodiments of the present disclosure, and are not intended to limit the present disclosure in any form. Without departing from the scope of the technical solution of the present disclosure, those of skill in the art may make many possible variations and modifications to the technical solution of the present disclosure or modify them into equivalent embodiments with equivalent variations using the above-described technical content. Therefore, any changes, equivalent variations and modifications made without departing from the scope of the technical solution of the present disclosure to the above embodiments according to the technology of the present disclosure shall fall within the protection scope of the technical solution.

The invention claimed is:

1. A rotary extrusion forming method for a cabin section workpiece, comprising a male die, a female die, an upper die assembly comprising (a) a push-pull device that comprises a left half male die retainer, a left retainer hydraulic cylinder, a right half male die retainer and a right retainer hydraulic cylinder, (b) an upper die base, and (c) a press connector, a lower die base and a rotation driving device; the male die is arranged on the upper die assembly which can drive the male die to move in the vertical and horizontal directions, and the female die is arranged on the lower die base in such a manner that the female die can rotate about a vertical axis; the rotation driving device is in drive connection with the female die and can drive the female die to rotate about the vertical axis; the method further comprises the following steps of:

S1: preparing a hollow truncated cone-shaped blank with openings at both ends;

S2: heating the prepared blank to a molding temperature and holding, and preheating the female die and the male die to above the molding temperature and holding;

S3: assembling the upper die assembly on a press;

S4: applying lubricant on the female die and the male die, and placing and fixing the blank into a die cavity of the female die;

S5: starting up the rotation driving device to drive the female die to rotate on the lower die base, so that the female die drives the blank to rotate; starting up the press to make the male die move down to a machining position of the blank in the die cavity through the upper die assembly, and machining inner side walls of the blank; and S6: after the blank is formed by machining, making the male die move up by the press to a preset position through the upper die assembly, in S5 to S6, machining the inner side walls of the blank by the male die specifically comprises steps as follows:

when the upper die base drives the left half male die and the right half male die to move down to the machining position of the blank in the die cavity, the press connector drives the wedge to move down, and the push-pull device drives the left half male die and the right half male die to feed separately to directly extrude the inner side wall of the blank;

after the left half male die and the right half male die extrude the inner side wall of the blank to a first forming position, the wedge remains motionless; after the upper die base drives the left half male die and the right half male die to move up along the inclined surfaces on the left side and right side of the wedge, respectively, to a second forming position, the press connector drives the wedge to move up; and after the push-pull device drives the left half male die and the right half male die to close and to move to a designated position, the upper die base drives the left half male die and the right half male die to move up to the preset position, thus extruding the blank into the cabin section workpiece of an irregularly-shaped thin-walled structure with a non-straight wall face as its machining face and with the openings at the both ends; and an inclined surface is provided on one side of the left half male die while an inclined surface is provided on one side of the right half male die; the inclined surface on the left side of the wedge matches with the inclined surface of the left half male die and that on the right side of the wedge matches with the inclined surface of the right half male die.

2. The rotary extrusion forming method for a cabin section workpiece according to claim 1, wherein, after the male die moves out of the die cavity to the preset position, the method further comprises a step of:

S7: jacking an ejector plate at the bottom of the die cavity up by an ejector bar, so as to strip the formed workpiece.

3. The rotary extrusion forming method for a cabin section workpiece according to claim 1, wherein, in S2, the molding temperature to which the blank is heated is a recrystallization temperature of the blank material, and the blank is heated to the molding temperature and held at the temperature for 4 to 6 hours.

4. The rotary extrusion forming method for a cabin section workpiece according to claim 1, wherein the male die comprises a left half male die and a right half male die, and the left half male die and the right half male die are movably arranged on the upper die base along the horizontal direction; a wedge, arranged between the left half male die and the right half male die, is connected to the press connector; the upper die base and the press connector are respectively in drive connection with the press; the push-pull device is arranged on the upper die base for driving the left half male die and the right half male die to move left and right along the horizontal direction.

5. The rotary extrusion forming method for a cabin section workpiece according to claim 4, wherein an inclined surface is formed on both sides of the wedge, respectively, and inclined surfaces, on which the wedge is arranged in a sliding manner, are formed between the left half male die and the right half male die; the wedge slides up and down on the inclined surfaces between the left half male die and the right half male die to drive the left half male die and the right half male die to open or close.

6. The rotary extrusion forming method for a cabin section workpiece according to claim 5, wherein the inclined surfaces on the both sides of the wedge are consistent with the gradient of outer side walls of the blank, and/or are consistent with the gradient of the inclined surfaces of the left half male die and the right half male die.

7. The rotary extrusion forming method for a cabin section workpiece according to claim 1, wherein the die cavity, having an inner wall consistent with the gradient of the outer side walls of the blank, is provided in the female die.

8. The rotary extrusion forming method for a cabin section workpiece according to claim 1, wherein a circular cavity, having a floating device arranged at the bottom thereof, is provided on the lower die base, and the female die is rotatably arranged in the circular cavity and floats up and down in the circular cavity through the floating device; a stopper, having a groove arranged on an inner side face thereof, is provided on an upper end face of the lower die base; and an annular stiffener is provided on the outer side wall of the female die, and the female die is clamped in the groove through the annular stiffener and can float up and down in the groove.

9. The rotary extrusion forming method for a cabin section workpiece according to claim 1, further comprising thrust bearing plates having an upper thrust bearing plate arranged at the bottom of the female die and a lower thrust bearing plate arranged at the bottom of the circular cavity; when the female die moves down to a lower limit position of the groove, the upper thrust bearing plate and the lower thrust bearing plate are interlocked to limit the movement of the female die.

10. The rotary extrusion forming method for a cabin section workpiece according to claim 1, wherein the blank is magnesium alloy, aluminum alloy or titanium alloy.

11. The rotary extrusion forming method for a cabin section workpiece according to claim 10, wherein, after the male die moves out of the die cavity to the preset position, the method further comprises a step of:

S7: jacking an ejector plate at the bottom of the die cavity up by an ejector bar, so as to strip the formed workpiece.

12. The rotary extrusion forming method for a cabin section workpiece according to claim 10, wherein, in S2, the molding temperature to which the blank is heated is a recrystallization temperature of the blank material, and the blank is heated to the molding temperature and held at the temperature for 4 to 6 hours.

13. The rotary extrusion forming method for a cabin section workpiece according to claim 10, wherein a circular cavity, having a floating device arranged at the bottom thereof, is provided on the lower die base, and the female die is rotatably arranged in the circular cavity and floats up and down in the circular cavity through the floating device; a stopper, having a groove arranged on an inner side face thereof, is provided on an upper end face of the lower die base; and an annular stiffener is provided on the outer side wall of the female die, and the female die is clamped in the groove through the annular stiffener and can float up and down in the groove.

14. The rotary extrusion forming method for a cabin section workpiece according to claim 10, further comprising thrust bearing plates having an upper thrust bearing plate arranged at the bottom of the female die and a lower thrust bearing plate arranged at the bottom of the circular cavity; when the female die moves down to a lower limit position of the groove, the upper thrust bearing plate and the lower thrust bearing plate are interlocked to limit the movement of the female die.

15. The rotary extrusion forming method for a cabin section workpiece according to claim 10, wherein the male die comprises a left half male die and a right half male die, and the left half male die and the right half male die are movably arranged on the upper die base along the horizontal direction; a wedge, arranged between the left half male die and the right half male die, is connected to the press connector; the upper die base and the press connector are respectively in drive connection with the press; the push-pull device is arranged on the upper die base for driving the left half male die and the right half male die to move left and right along the horizontal direction.

16. The rotary extrusion forming method for a cabin section workpiece according to claim 15, wherein an inclined surface is formed on both sides of the wedge, respectively, and inclined surfaces, on which the wedge is arranged in a sliding manner, are formed between the left half male die and the right half male die; the wedge slides up and down on the inclined surfaces between the left half male die and the right half male die to drive the left half male die and the right half male die to open or close.

17. The rotary extrusion forming method for a cabin section workpiece according to claim 16, wherein the inclined surfaces on the both sides of the wedge are consistent with the gradient of outer side walls of the blank, and/or are consistent with the gradient of the inclined surfaces of the left half male die and the right half male die.

18. The rotary extrusion forming method for a cabin section workpiece according to claim 1, wherein the die cavity, having an inner wall consistent with the gradient of the outer side walls of the blank, is provided in the female die.

* * * * *